US008733727B2

(12) United States Patent
Vanagan

(10) Patent No.: US 8,733,727 B2
(45) Date of Patent: May 27, 2014

(54) CONNECTOR FOR CONNECTING PERPENDICULAR FORMWORK PANELS IN A FORMWORK ASSEMBLY

(75) Inventor: Peter Vanagan, Delta (CA)

(73) Assignee: Hy-Rise Scaffolding Ltd., Delta (CA)

( * ) Notice: Subject to any disclaimer, the term of this patent is extended or adjusted under 35 U.S.C. 154(b) by 54 days.

(21) Appl. No.: 13/371,907

(22) Filed: Feb. 13, 2012

(65) Prior Publication Data

US 2012/0205517 A1 Aug. 16, 2012

Related U.S. Application Data

(60) Provisional application No. 61/443,221, filed on Feb. 15, 2011.

(51) Int. Cl.
*E04G 17/00* (2006.01)
*E04G 11/08* (2006.01)

(52) U.S. Cl.
CPC ..... *E04G 17/001* (2013.01); *E04G 11/082* (2013.01)
USPC ..... 249/36; 249/37; 249/194

(58) Field of Classification Search
CPC ..... E04G 9/08; E04G 11/082; E04G 13/02; E04G 13/021; E04G 13/023; E04G 15/06; E04G 15/063; E04G 17/001; B22C 9/22; B22C 9/24
USPC ..... 249/17, 27, 36, 37, 48, 49, 50, 51, 194, 249/152
See application file for complete search history.

(56) References Cited

U.S. PATENT DOCUMENTS

| | | | | | |
|---|---|---|---|---|---|
| 1,552,334 | A * | 9/1925 | Mosher | 249/219.1 |
| 2,543,892 | A * | 3/1951 | Carpenter | 249/144 |
| 2,671,910 | A * | 3/1954 | Wallen | 5/280 |
| 3,368,251 | A * | 2/1968 | Williams | 249/48 |
| 3,672,626 | A * | 6/1972 | Thornton | 249/48 |
| 3,844,526 | A * | 10/1974 | McCracken | 249/152 |
| 4,447,035 | A * | 5/1984 | Ivey et al. | 249/194 |
| 4,519,570 | A * | 5/1985 | Strickland et al. | 249/194 |
| 4,520,988 | A * | 6/1985 | Walker | 249/13 |
| 4,570,896 | A * | 2/1986 | Strickland et al. | 249/27 |
| 5,230,907 | A * | 7/1993 | Strickland | 425/107 |
| 7,014,384 | B2 * | 3/2006 | Nicoletti | 403/234 |
| 2008/0017783 | A1 | 1/2008 | Vanagan | |

* cited by examiner

*Primary Examiner* — Michael Safavi

(74) *Attorney, Agent, or Firm* — Cameron IP.

(57) ABSTRACT

A connector for connecting formwork panels in a formwork assembly comprises a first elongate portion having triangular cross-section, a second elongate in sliding contact with the first elongate portion, and a third elongate portion in sliding contact with the first elongate portion. A guiding device is coupling the first elongate portion, the second elongate portion, and the third elongate portion. An actuator drives movement of the second elongate portion and third movement along the guiding device. The second elongate portion and the third elongate portion are movable toward and away from each. The second and third elongate portions also each being movable relative to the first elongate portion.

16 Claims, 10 Drawing Sheets

CONNECTOR FOR CONNECTING PERPENDICULAR FORMWORK PANELS IN A FORMWORK ASSEMBLY

CROSS-REFERENCE TO RELATED APPLICATION

This application claims the benefit of provisional application 61/443,221 filed in the United States Patent and Trademark Office on Feb. 15, 2011, the disclosure of which is incorporated herein by reference and priority to which is claimed.

BACKGROUND OF THE INVENTION

1. Field of the Invention

The present invention relates to formwork assemblies and, in particular, to a connector for connecting two perpendicular formwork panels or wall forms together in a formwork assembly.

2. Description of the Related Art

It is known to employ wall forms to cast concrete walls during the construction of concrete buildings. A wall form is a formwork assembly comprised of a plurality of adjacent, co-planar formwork panels. The formwork panels are typically rectangular plywood boards mounted in frames formed by elongate metal extrusions. Connectors are used to connect a desired number of formwork panels to allow for the casting of flush concrete walls of varying lengths.

It is also known to connect perpendicular formwork panels to allow for the casting of concrete corners during the construction of concrete buildings. However, conventional connectors for connecting perpendicular formwork panels can be difficult to release. There is accordingly a need for an improved connector for connecting perpendicular formwork panels in a formwork assembly.

SUMMARY OF THE INVENTION

It is an object of the present invention to provide an improved connector for connecting perpendicular formwork panels or wall forms in a formwork assembly.

It is another object of the present invention to provide a quick release connector for connecting perpendicular formwork panels or wall forms in a formwork assembly.

There is accordingly provided a connector for connecting two perpendicular formwork panels together. The connector comprises a first elongate portion having triangular cross-section, a second elongate portion in sliding contact with the first elongate portion, and a third elongate portion also in sliding contact with the first elongate portion. A guiding device is coupled to each of the first elongate portion, the second elongate portion, and the third elongate portion. An actuator drives movement of the second elongate portion and the third elongate portion along the guiding device. The second elongate portion and the third elongate portion are movable toward and away from each other. The second and third elongate portions also each being movable relative to the first elongate portion.

The second elongate portion and the third elongate portion may oppose one another and may be in sliding contact with a same side of the first elongate portion. The second elongate portion and the third elongate portion may also be minor images of one another. The guiding device may include a guide rod extending between the second elongate portion and the third elongate portion. The second elongate portion and the third elongate portion may each be movable along the guiding rod. The actuator may be a hydraulic actuator disposed between the second elongate portion and the third elongate portion. The connector may further include a valve to allow lubricant to be discharged between the first elongate portion and the second elongate portion, and a valve to allow lubricant to be discharged between the first elongate portion and the third elongate portion.

In one embodiment of the connector the first elongate portion has a triangular cross-section with two side walls. Each of the side walls of the first elongate portion has a flange extending along an edge thereof at approximately a forty five degree angle relative to the side wall. The second elongate portion has a first side wall and a second side wall. A flange extends along an edge of the first side wall of the second elongate portion at approximately a one hundred and thirty five degree angle relative to the first side wall of the second elongate portion. The flange of the second elongate portion is in sliding contact with the flange of a corresponding one of the side walls of the first elongate portion. The third elongate portion also has a first side wall and a second side wall. A flange extends along an edge of the first side wall of the third elongate portion at approximately a one hundred and thirty five degree angle relative to the first side wall of the third elongate portion. The flange of the third elongate portion is in sliding contact with the flange of a corresponding one of the side walls of the first elongate portion.

The first elongate portion includes a mounting plate disposed between the two side walls thereof. The second elongate portion is configured such that the first side wall and second side wall thereof are perpendicular. There is a mounting plate disposed between the first side wall and the second side wall of the second elongate portion. The third elongate portion is configured such that the first side wall and the second side wall thereof are perpendicular. There is a mounting plate disposed between the first side wall and the second side wall of the third elongate portion. The guiding device includes a pair of spaced-apart feet, a divider disposed between the feet, and a guide rod extending through the feet and the divider. Each of the feet is mounted on a corresponding one of the mounting plate of the second elongate portion and the mounting plate of the third elongate portion. The divider is mounted on the mounting plate of the first elongate portion. Each of the feet is moveable along the guide rod between the divider and a corresponding stop on the guide rod to thereby move the second elongate portion and the third elongate portion toward and away from each other. The actuator which drives movement of the second elongate portion and the third elongate portion along the guide rod of the guiding device is a hydraulic actuator extending between the second elongate portion and the third elongate portion.

The connector disclosed herein may be used to connect a first formwork panel to a second formwork panel in a formwork assembly wherein the first formwork panel is perpendicular to the second formwork panel.

The connector disclosed herein is particularly useful when used in the casting of an elevator shaft. Quick release of the connector allows formwork panels, which are part of a formwork assembly used to cast the elevator shaft, to be quickly released and moved upward for use in the casting of the next portion of the elevator shaft. This allows the elevator shaft to be quickly and efficiently cast.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
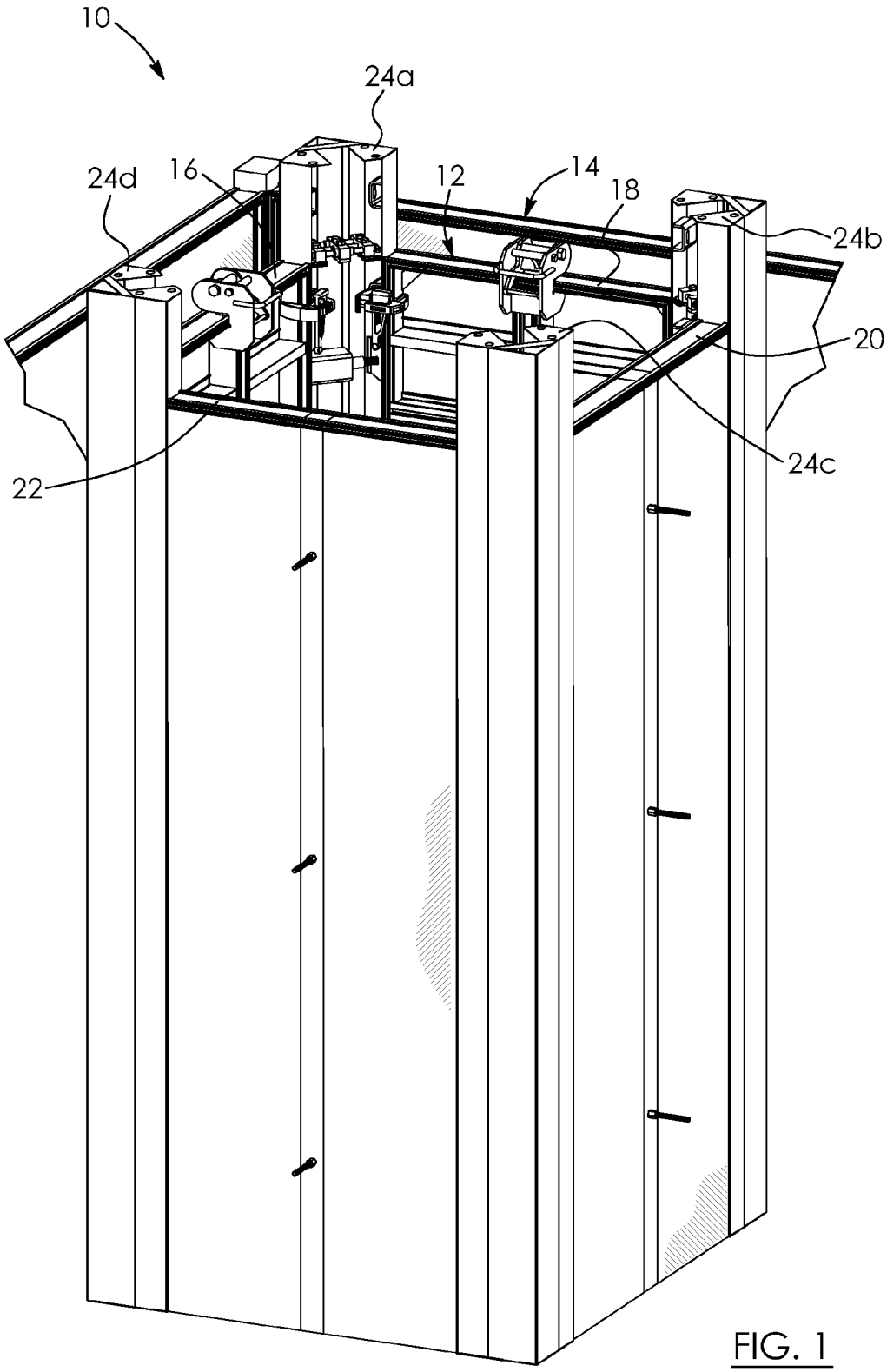
FIG. 1 is a perspective, fragmentary view of a formwork assembly provided with an improved connector for connecting perpendicular formwork panels.
Figure 2:
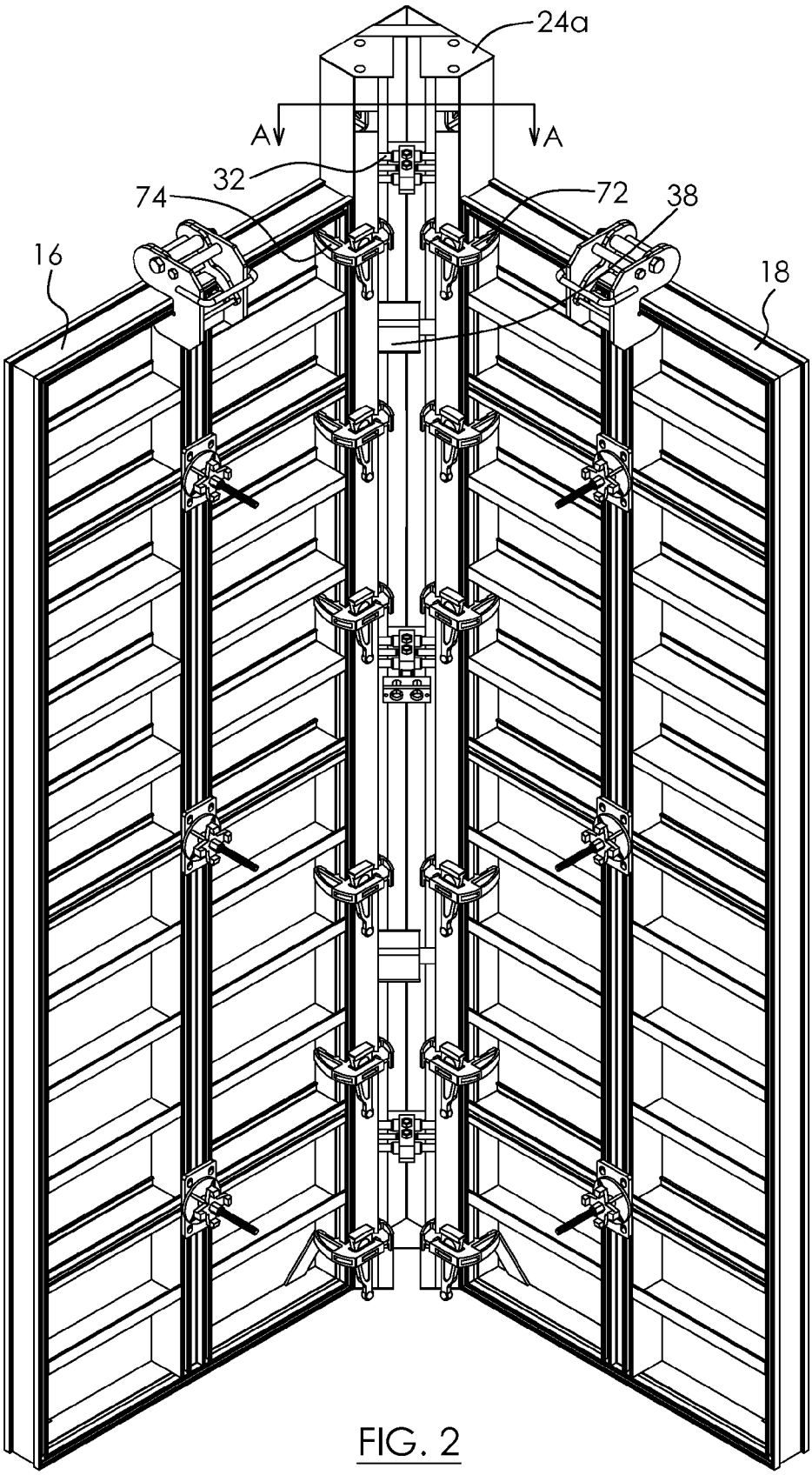
FIG. 2 is a perspective, fragmentary view of an inner formwork subassembly of the formwork assembly of FIG. 1.

Referring to the drawings and first to FIG. 1, this shows a formwork assembly 10 which is used to cast an elevator shaft in this example, although the formwork assembly 10 may be used to cast other concrete walls. The formwork assembly 10 includes an inner formwork subassembly 12 and an outer formwork subassembly 14 which is shown in fragment. It will be understood by a person skilled in the art that the walls of the elevator shaft are cast between the inner formwork subassembly 12 and the outer formwork subassembly 14. The inner formwork subassembly 12 includes four wall forms 16, 18, 20 and 22 which are arranged in a quadrilateral formation. The form walls may include a plurality of formwork panels. The inner formwork subassembly 12 also includes connectors 24*a*, 24*b*, 24*c* and 24*d*. The connectors function to connect together adjacent wall forms of the inner formwork assembly 12. A first connector 24*a* connects two perpendicular wall forms 16 and 18 together. A second connector 24*b* connects two perpendicular wall forms 18 and 20 together. A third connector 24*c* connects two perpendicular wall forms 20 and 22 together. A fourth connector 24*d* connects two perpendicular wall forms 16 and 22 together. FIG. 2 shows the first connector 24*a* connecting wall forms 16 and 18 in greater detail.

The connectors 24*a*, 24*b*, 24*c* and 24*d* are substantially identical in structure and function. Accordingly, only the first connector 24*a* is described in detail herein with the understanding that the remaining connectors 24*b*, 24*c* and 24*d* have a substantially identical structure and function in a substantially identical manner. The first connector 24*a* is shown in greater detail in FIG. 3. The connector 24*a* includes three juxtaposed elongate portions 26, 28 and 30 which are coupled together by a plurality of guiding devices 32, 34 and 36. In this example, each of the elongate portions 26, 28 and 30 extend the full height of the connector 24*a*. The connector 24*a* also includes actuators 38 and 40 which drive relative movement of the elongate portions 28 and 30 as will be described in greater detail below. In this example, the actuators 38 and 40 are hydraulic actuators but in other embodiments other types of actuators may be used such as pneumatic or electrical actuators.

Figure 4:
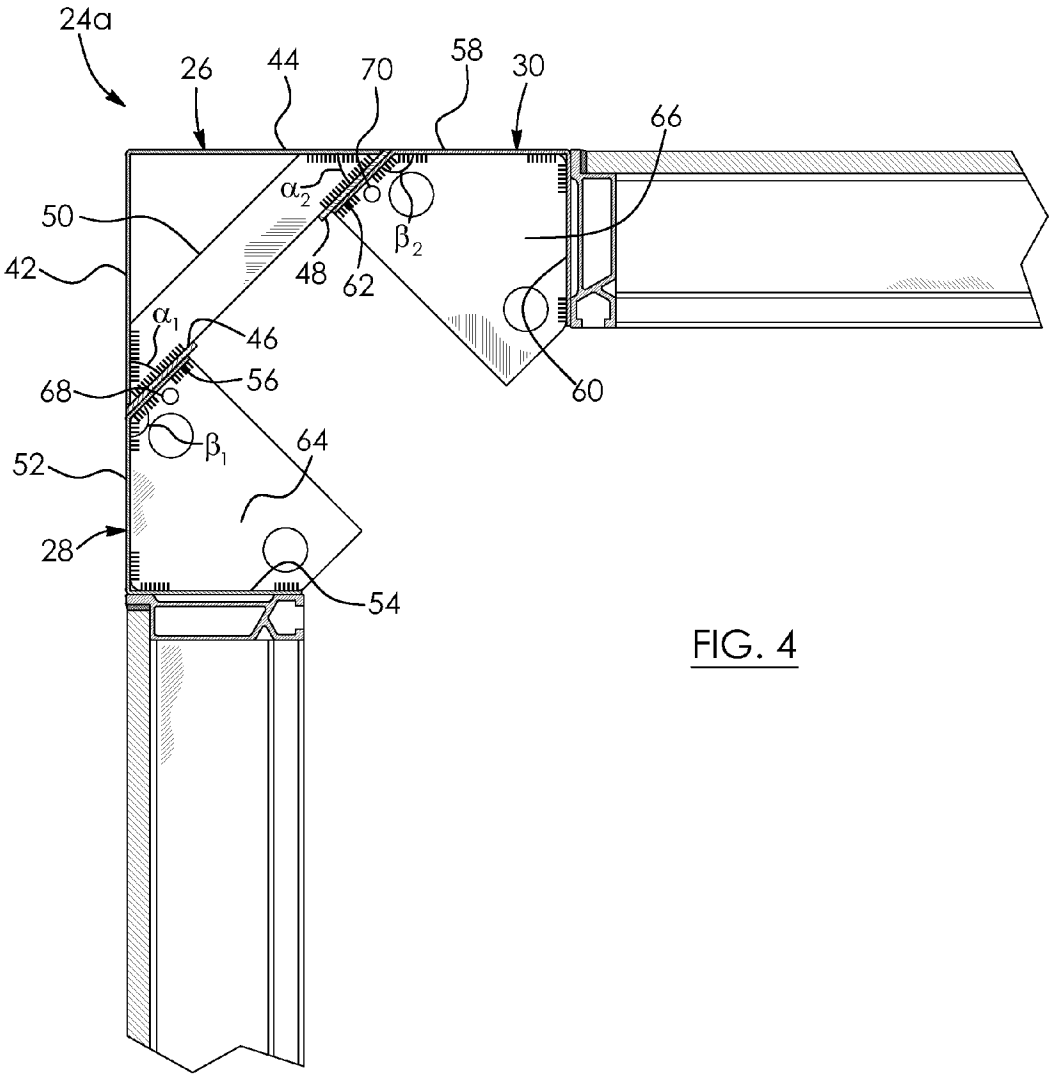
FIG. 4 is a plan view showing a top of a connector which is connecting perpendicular panels of the formwork assembly of FIG. 1, the panels being shown in fragment.

The juxtaposed elongate portions 26, 28 and 30 are shown in greater detail in FIG. 4. A first elongate portion 26 includes a pair of perpendicular side walls 42 and 44 which extend the length of the first elongate portion 26. The side walls 42 and 44 of the first elongate portion 26 define an inner corner of the elevator shaft when cast. Each of the side walls 42 and 44 of the first elongate portion is provided with respective flanges 46 and 48 extending along free longitudinal edges thereof. The flanges 46 and 48 extend the length of the first elongate portion at approximately forty five degree angles $\alpha_1$ and $\alpha_2$ relative to the corresponding side walls 42 and 44, thereby providing the first elongate portion 26 with a generally triangular cross-section and, in particular, a right angled triangle cross-section. The first elongate portion 26 is also provided with an end plate 50 extending between the side walls 42 and 44 thereof. The first elongate portion 26 also has a plurality of similar intermediate mounting plates, for example intermediate mounting plate 94 shown in FIG. 6, spaced apart along a longitudinal length thereof.

Referring back to FIG. 4, the second and third elongate portions 28 and 30 are minor images of each other. The second elongate portion 28 includes a pair of perpendicular side walls 52 and 54 which extend the length of the second elongate portion 28. The second elongate portion 28 also includes a flange 56 which extends the length of the second elongate portion 28 at an approximately one hundred and thirty five degree angle $\beta_1$ relative to one of the side walls 52. Likewise, the third elongate portion 30 includes a pair of perpendicular side walls 58 and 60 and a flange 62 which extends the length of the third elongate portion 30 at an approximately one hundred and thirty five degree angle $\beta_2$ relative to one of the side walls 58. The second and third elongate portions 28 and 30 both also further include corresponding end plates 64 and 66 as well as a plurality of similar intermediate mounting plates, for example intermediate mounting plates 84 and 86 shown in FIG. 5, spaced apart along longitudinal lengths thereof. Referring back to FIG. 4, the flange 56 of the second elongate portion 28 is in sliding contact with the flange 46 of the first elongate portion 26. Likewise the flange 62 of the third elongate portion 30 is in sliding contact with the flange 48 of the first elongate portion 26.

The second and third elongate portions 28 and 30 still further include corresponding valves 68 and 70 which allow lubricant to be discharged between abutting flanges of the connector 24*a*. One of the valves 68 allows lubricant to be discharged between the flange 46 of the first elongate portion 26 and the flange 56 of the second elongate portion 28. The other one of the valves 70 allows lubricant to be discharged between the flange 48 of the first elongate portion 26 and the flange 62 of the third elongate portion 30.

Figure 3:
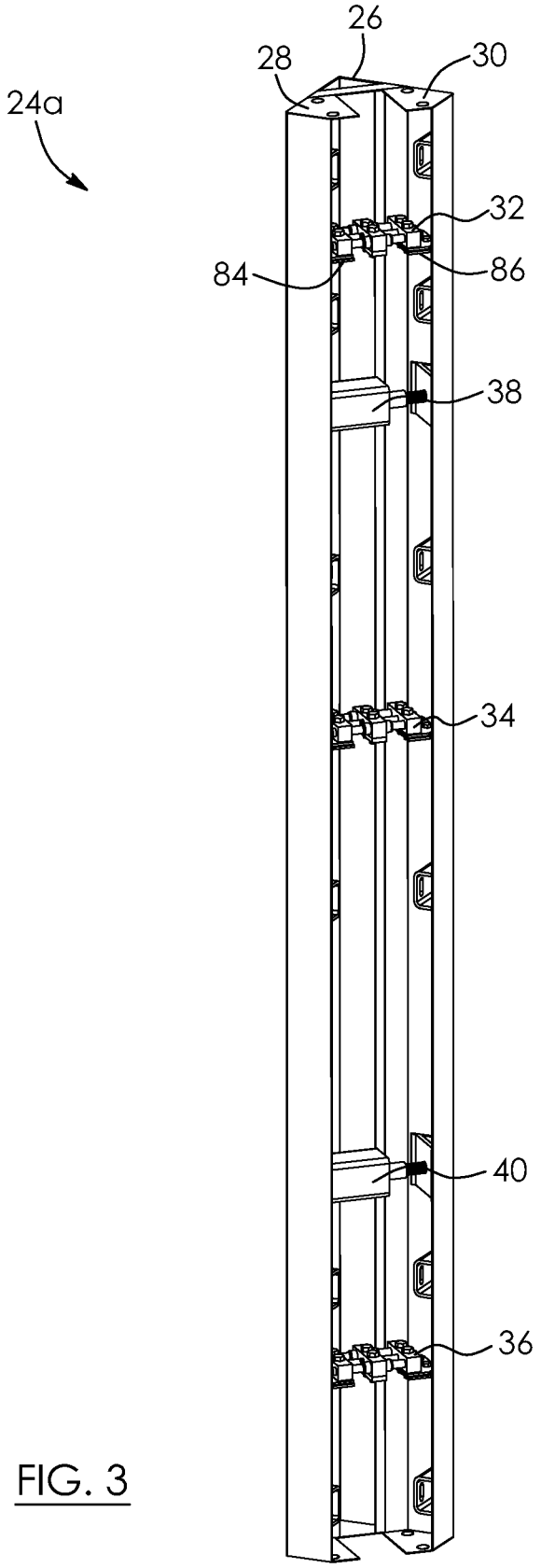
FIG. 3 is a perspective view showing a connector of the formwork assembly of FIG. 1.
Figure 5:
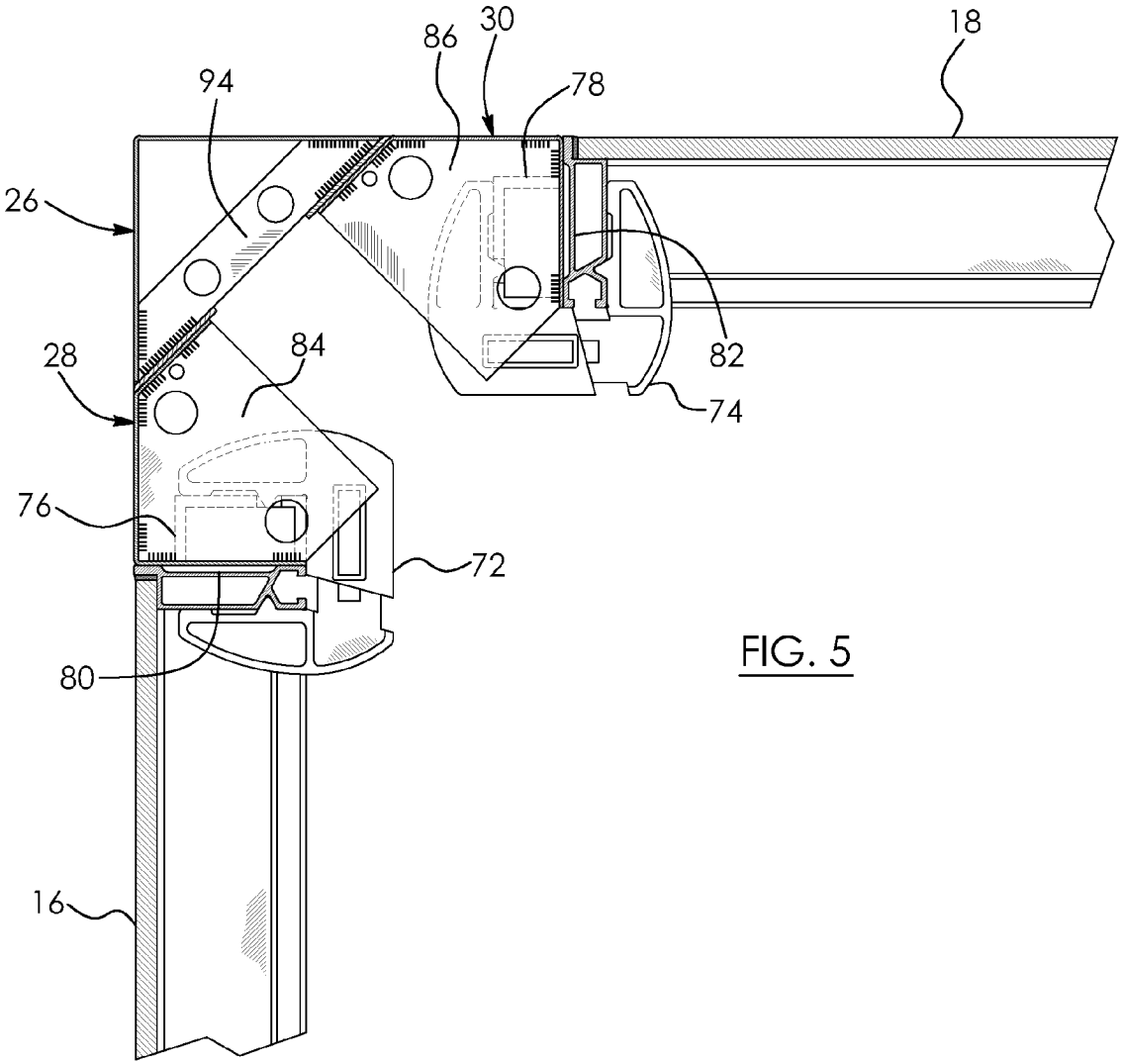
FIG. 5 is a view taken along line A-A of FIG. 2 showing intermediate plates and clamps of a connector which is connecting perpendicular panels of the formwork assembly of FIG. 1, the panels being shown in fragment.

FIG. 5 shows how the second and third elongate portions 28 and 30 are secured to adjacent wall forms 16 and 18 by clamps 72 and 74. In this example, the clamps 72 and 74 are similar to the type disclosed in United States Patent Application Publication Number 2008/0017783 A1, the full disclosure of which is incorporated herein by reference. The wall forms are ALPAN™ wall forms available from National Forming Systems Inc. of 7411 Vantage Way, Delta, British Columbia, Canada V4G 1C9. However, any suitable clamps and wall forms may be used. The clamps 72 and 74 respectively engage support portions 76 and 78 of the second and third elongate portions 28 and 30 and support portions 80 and 82 of the adjacent wall forms 16 and 18. The clamps 72 and 74 engage the support portions in a manner similar to what is described in earlier United States Patent Application Publication Number 2008/0017783. FIG. 5 also shows an intermediate plate 84 of the second elongate portion 28 and an intermediate plate 86 of the third elongate portion 30. In FIG. 5 the intermediate plates 84 and 86 are disposed above the clamps 72 and 74. Corresponding ones of the intermediate plates support respective guiding devices as shown in FIG. 3 for guiding device 32 and intermediate plates 84 and 86.

Figure 6:
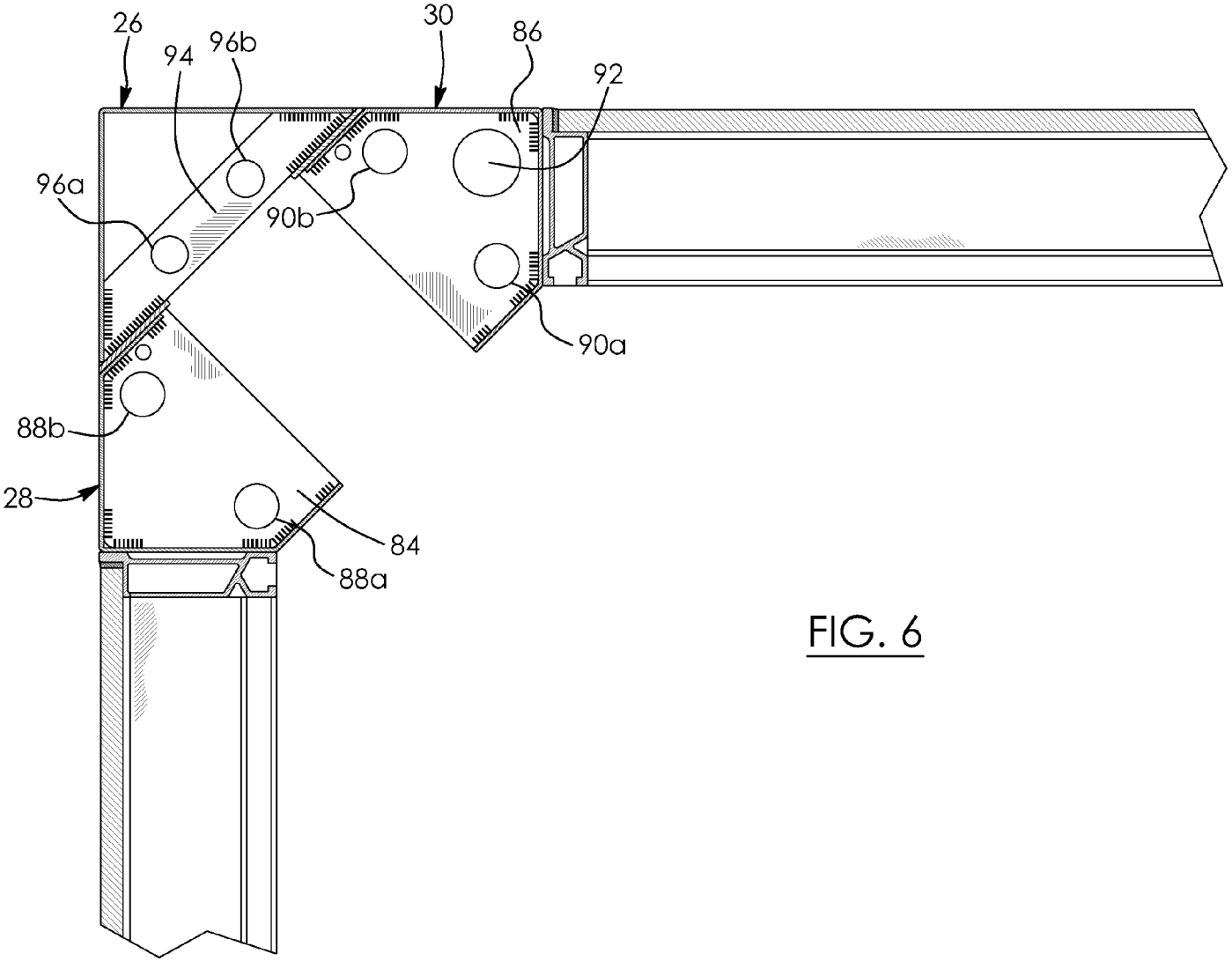
FIG. 6 is a plan view showing intermediate plates of FIG. 4 in greater detail without the clamps.

The intermediate plates 84 and 86 are shown in greater detail in FIG. 6. The other intermediate plates of the second and third intermediate portions 28 and 30 are similar. The intermediate plate 84 of the second elongate portion 28 is provided with a pair of apertures 88*a* and 88*b* to allow a guiding device to be mounted. The intermediate plate 86 of the third elongate portion 30 is also provided with a pair of apertures 90*a* and 90*b* to allow a guiding device to be mounted. The intermediate plate 86 of the third elongate portion is further provided with a third aperture 92 which is not used to mount a guiding device but allows debris to be moved off of the intermediate plate 86. FIG. 6 further shows an intermediate plate 94 of the first elongate portion 26 which is also provided with a pair of apertures 96*a* and 96*b* to allow a guiding device to be mounted.

Figure 7:
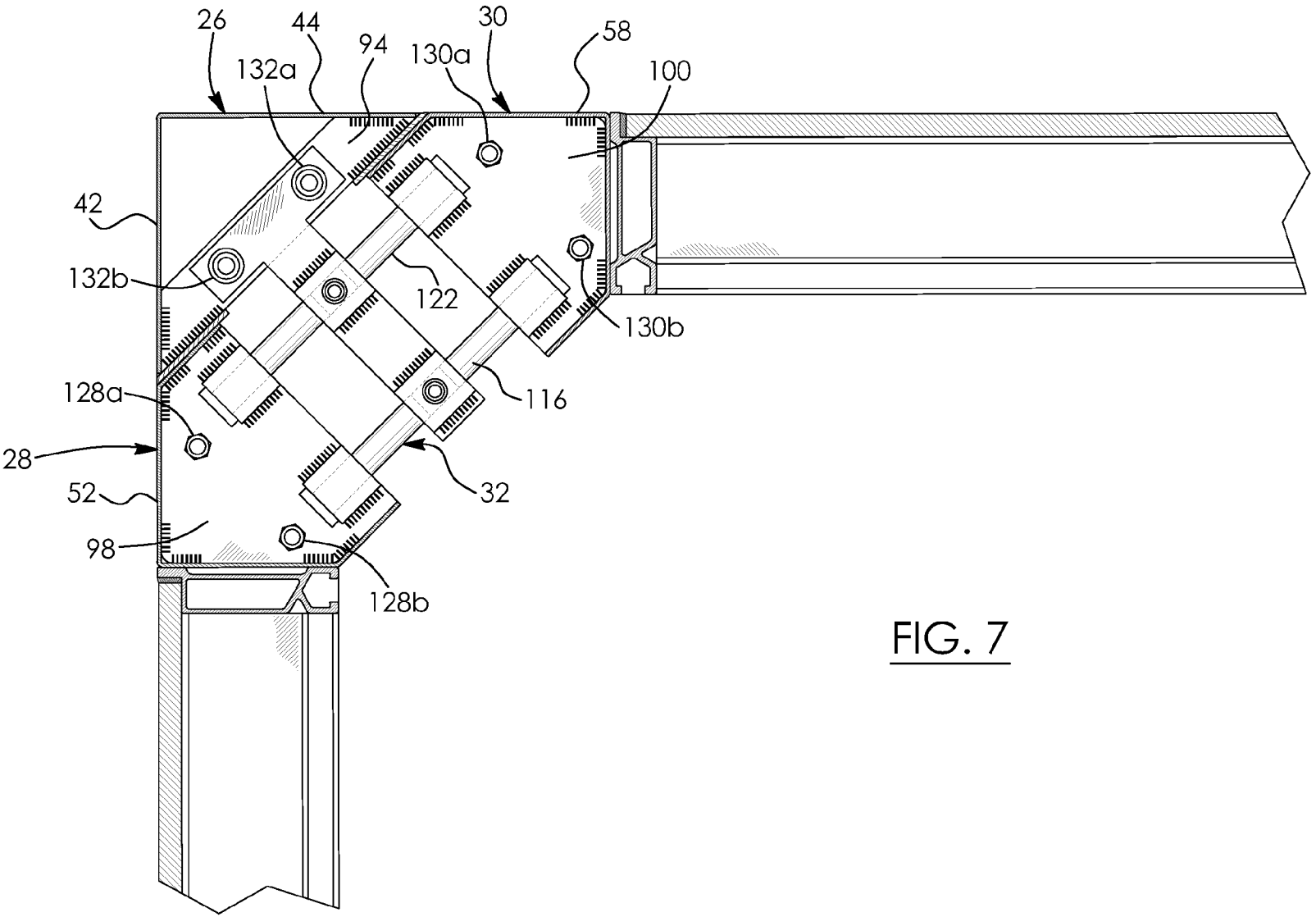
FIG. 7 is a plan view of a guiding device of a connector which is connecting perpendicular panels of the formwork assembly of FIG. 1.
Figure 8:
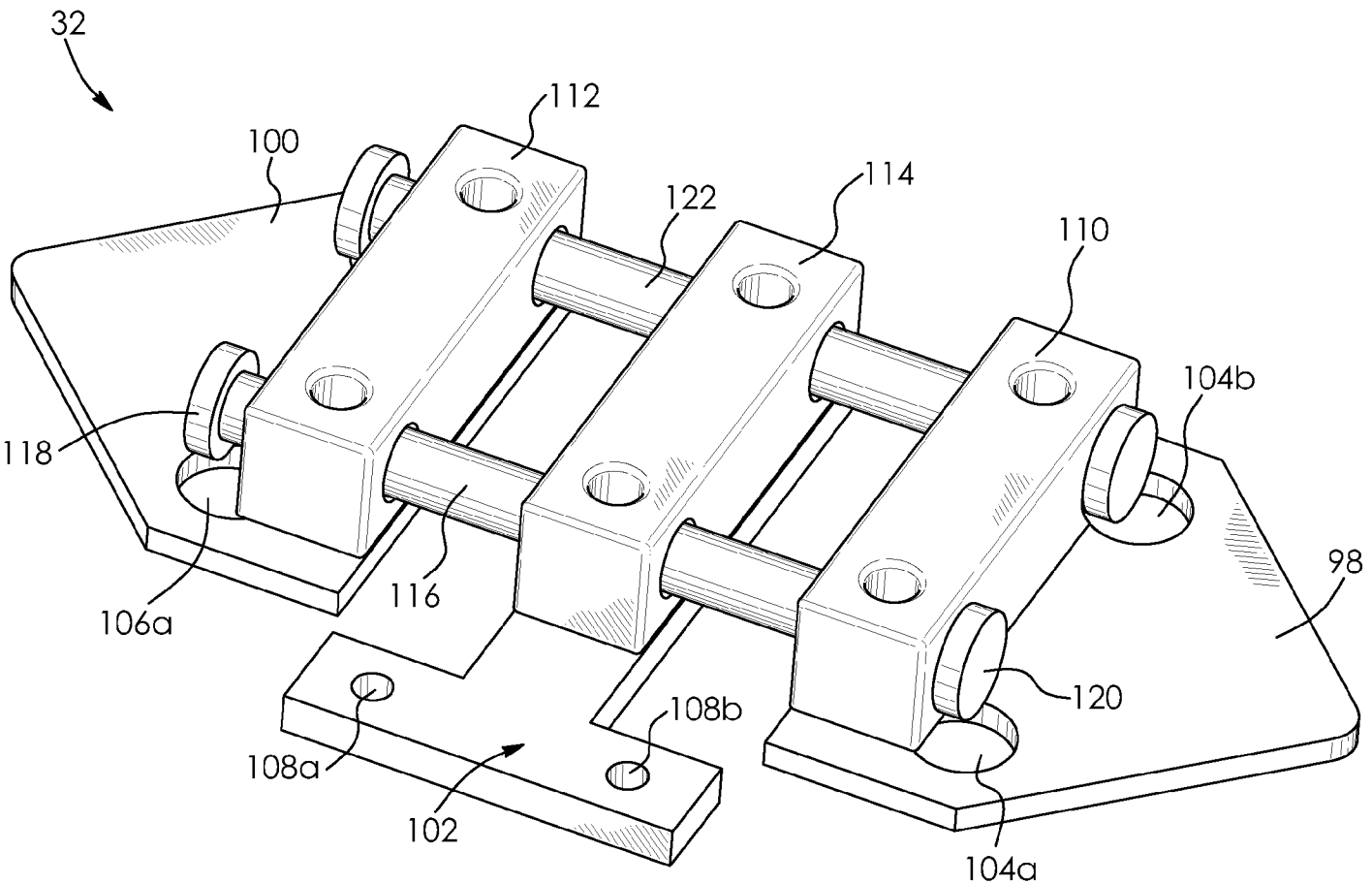
FIG. 8 is a perspective view showing the guiding device of FIG. 7 in greater detail.

FIG. 7 shows one of the guiding devices 32 mounted on the intermediate plates 84, 86 and 94 of FIG. 6. The guiding devices 32, 34 and 36 are substantially identical in structure and function. Accordingly, only one of the guiding devices 32 is described in detail herein with the understanding that the remaining guiding devices 34 and 36 have a substantially identical structure and function in a substantially identical manner. The guiding device 32 is shown in greater detail in FIG. 8. The guiding device 32 includes a pair of spaced apart feet 98 and 100 with a substantially T-shaped divider 102 therebetween. In this example, foot 98 has the same shape as intermediate plate 84 of the second elongate portion 28 and foot 100 has the same shape as the intermediate plate 86 of the third elongate portion 30. Foot 98 is provided with apertures 104*a* and 104*b* to allow the foot 98 to be bolted to the intermediate plate 84 of the second elongate portion 28. Foot 100 is provided with an aperture 106*a* and another aperture (not shown in FIG. 7) to allow the foot 100 to be bolted to the intermediate plate 86 of the third elongate portion 30. The T-shaped divider 102 has apertures 108*a* and 108*b* to allow the T-shaped divider 102 to be bolted to the intermediate plate 94 of the first elongate portion 26.

The feet 98 and 100 have respective blocks 110 and 112. The T-shaped divider 102 also has a block 114. A guide rod 116 extends through apertures in the blocks 110, 112, and 114. The feet 98 and 100 are slidable along the rod 116 with a stop in the form of a protuberance 118 on the rod preventing foot 98 from sliding off the guide rod 116 and a stop in the form of a protuberance 120 on the rod preventing foot 100 from sliding off the guide rod 116. The feet 98 and 100 are accordingly slidable between the T-shaped divider 102 and the protuberances 118 and 120. In the embodiment of the guiding device 32 shown in FIG. 8 there is an additional guide rod 122. Referring back to FIG. 7, foot 98 is secured to the second elongate portion 28 by bolts 128*a* and 128*b*. Foot 100 is secured to the third elongate portion 30 by bolts 130*a* and 130*b*, and the T-shaped divider 102 is secured to the first elongate portion 26 by bolts 132*a* and 132*b*. The guiding device 32 thereby couples the three elongate portions 26, 28 and 30 together.

Figure 9:
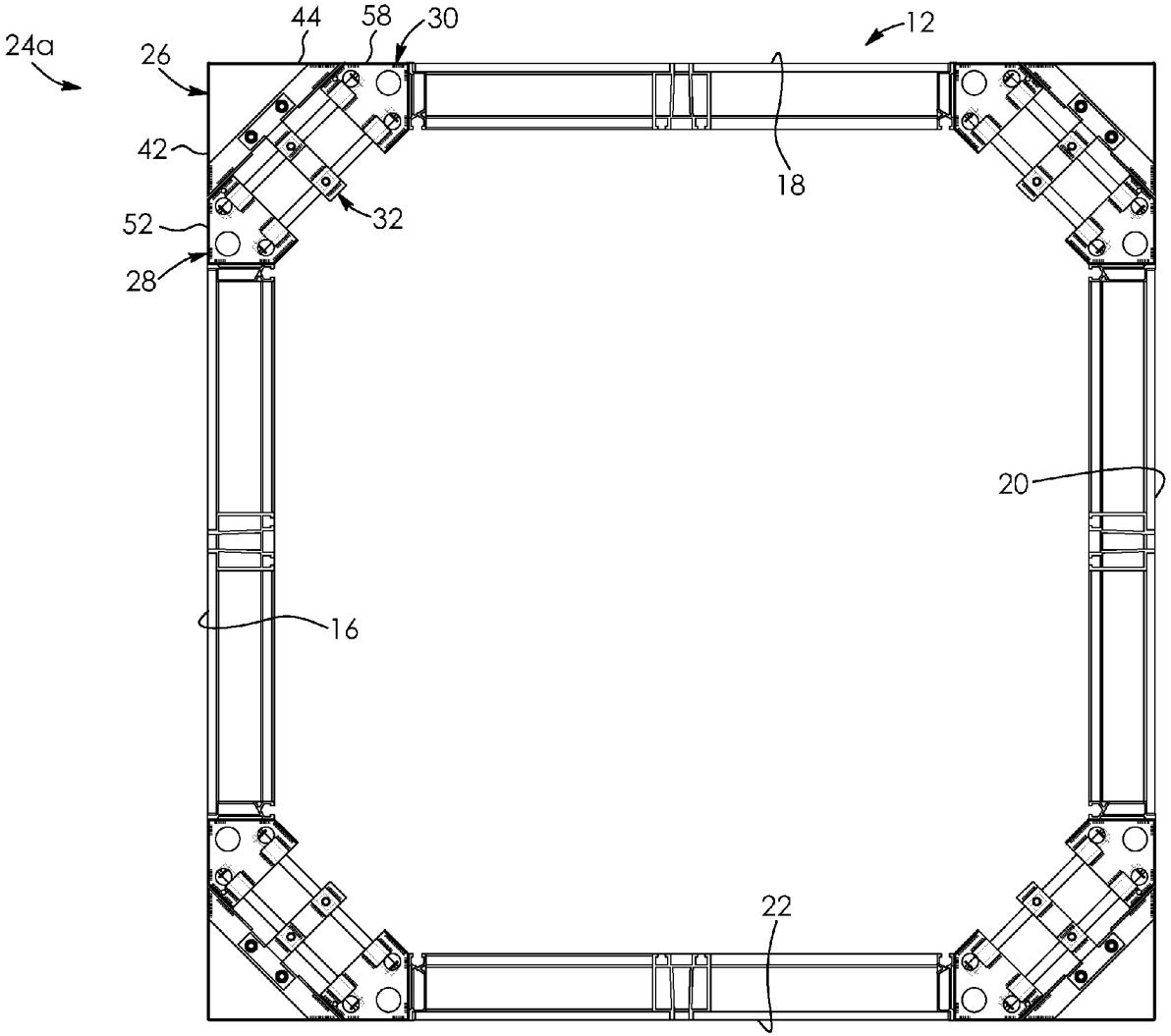
FIG. 9 is a top plan view showing the formwork assembly of FIG. 1 engaging a cast concrete wall.
Figure 10:
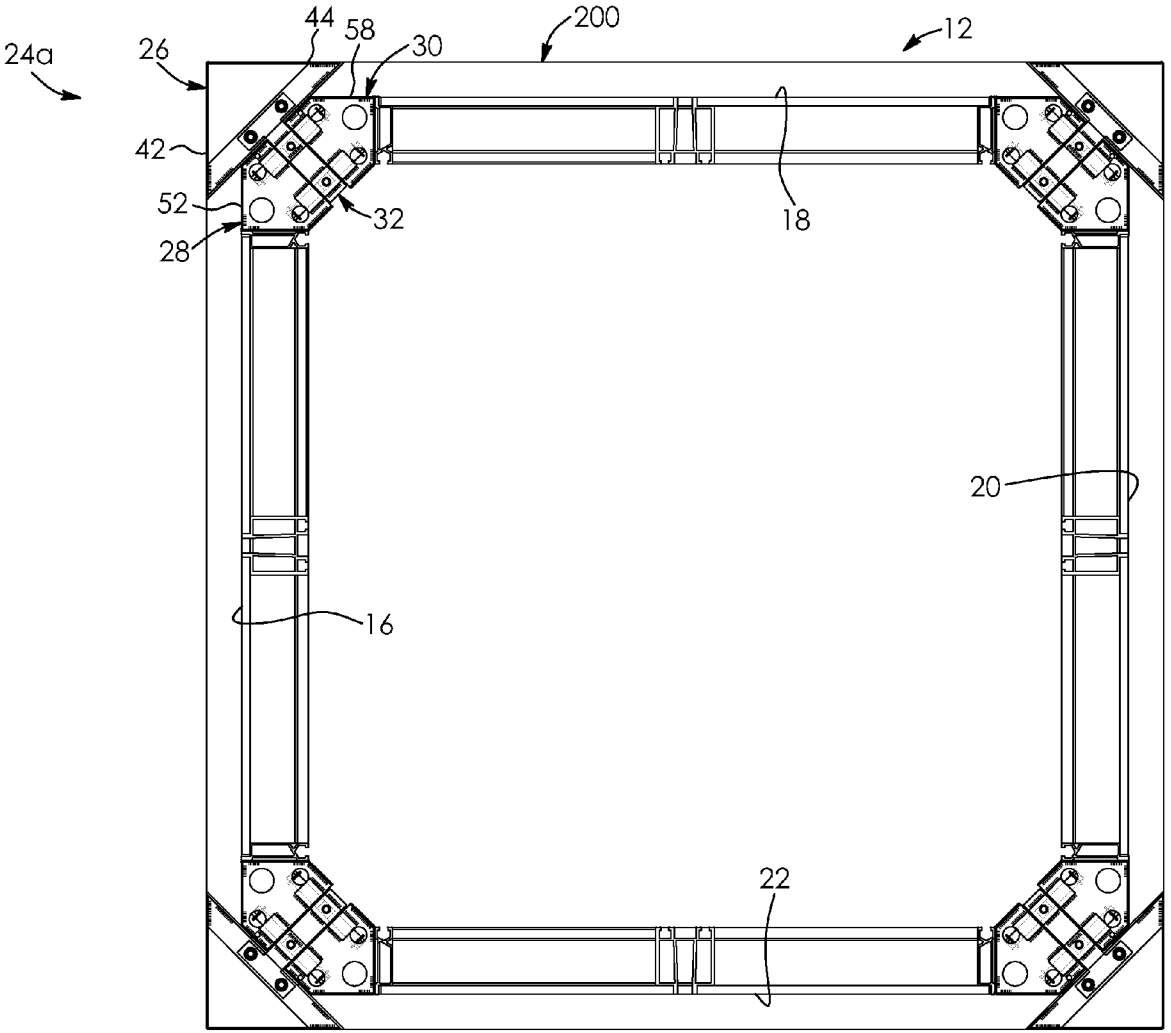
FIG. 10 is a top plan view showing the formwork assembly of FIG. 1 releasing the cast concrete wall.

As shown in FIG. 9, when in use the guiding device 32 is fully extended, i.e. the feet 98 and 100 are slid to their outermost limits along guide rods 116 and 122, the side wall 42 of the first elongate portion 26 is flush with the side wall 52 of the second elongate portion 28 and the side wall 44 of the first elongate portion 26 is flush with the side wall 58 of the third elongate portion 30. This allows a concrete corner (not shown) to be cast. Once the corner is cast the hydraulic actuators 38 and 40 shown in FIG. 3 retract, causing the feet 98 and 100, shown in FIG. 8, to slide along the guide rods 116 and 122 towards the T-shaped divider 102. As shown in FIG. 10 this causes the second and third elongate portions 28 and 30 to move relative to the first elongate portion 26 whereby the side wall 52 of the second elongate portion 28 is offset inwardly with respect to the side wall 42 of the first elongate portion 26 and the side wall 58 of the third elongate portion 30 is offset inwardly with respect to the side wall 44 of the first elongate portion 26.

Since, as shown in FIG. 5, the second and third elongate portions 28 and 30 are clamped to the wall forms 16 and 18, movement of the second and third elongate portions 28 and 30 causes the wall forms 16 and 18 to move inwardly and release a cast wall 200 shown in FIG. 10. The inner formwork subassembly 12 may then be moved upward for use in the casting of the next portion of the elevator shaft above. After the inner formwork subassembly 12 is moved upwards the actuators are extended causing the feet 98 and 100 to slide to their outermost limit along guide rod 116 whereby, as shown in FIG. 9, the side wall 42 of the first elongate portion 26 is flush with the side wall 52 of the second elongate portion 28 and the side wall 44 of the first elongate portion 26 is flush with the side wall 58 of the third elongate portion 30. This allows the next portion of the elevator shaft to be cast.

It will be understood by a person skilled in the art that many of the details provided above are by way of example only, and are not intended to limit the scope of the invention which is to be determined with reference to the following claims.

What is claimed is:

1. A connector for connecting two perpendicular formwork panels together, the connector comprising:

a first elongate portion having a substantially triangular cross-section;

a second elongate portion in sliding contact with the first elongate portion;

a third elongate portion in sliding contact with the first elongate portion;

a guiding device coupled to each of the first elongate portion, the second elongate portion, and the third elongate portion; and an actuator to drive movement of the second elongate portion and the third elongate portion along the guiding device, wherein the second elongate portion and the third elongate portion are movable toward and away from each other, and wherein the second elongate portion and the third elongate portion are each movable relative to the first elongate portion.

2. The connector as claimed in claim 1 wherein the second elongate portion and the third elongate portion oppose each other and are in sliding contact with a same side of the first elongate portion.

3. The connector as claimed in claim 1 wherein the second elongate portion and the third elongate portion are mirror images of one another.

4. The connector as claimed in claim 1 wherein the guiding device includes a guide rod extending between the second elongate portion and the third elongate portion, and the second elongate portion and the third elongate portion are each movable along the guide rod.

5. The connector as claimed in claim 1 wherein the actuator is a hydraulic actuator disposed between the second elongate portion and the third elongate portion.

6. The connector as claimed in claim 1 further including a valve to allow lubricant to be discharged between the first elongate portion and the second elongate portion.

7. The connector as claimed in claim 1 further including a valve to allow lubricant to be discharged between the first elongate portion and the third elongate portion.

8. The connector as claimed in claim 1 wherein the first elongate portion has two side walls and a flange extending along an edge of each of the side walls, the second elongate portion being in sliding contact with a flange of a first one of the side walls of the first elongate portion, and the third elongate portion being in sliding contact with a flange of a second one of the side walls of the first elongate portion.

9. The connector as claimed in claim 8 wherein the second elongate portion has a flange in sliding contact with the flange of the first one of the side walls of the first elongate portion, and the third elongate portion has a flange in sliding contact with the flange of the second one of the side walls of the first elongate portion.

10. The connector as claimed in claim 1 wherein the first elongate portion, the second elongate portion, and the third elongate portion each have a mounting plate and the guiding device is coupled to the mounting plate of each of the first elongate portion, the second elongate portion, and the third elongate portion.

11. A connector for connecting two perpendicular formwork panels together, the connector comprising:

a first elongate portion having a triangular cross-section with two side walls, each of the side walls having a flange extending along an edge thereof;

a second elongate portion having a first side wall and a second side wall, a flange extending along an edge of the first side wall of the second elongate portion and the flange extending along the edge of the first side wall of the second elongate portion being in sliding contact with the flange of a corresponding one of the side walls of the first elongate portion;

a third elongate portion having a first side wall and a second side wall, a flange extending along an edge of the first side wall of the third elongate portion and the flange extending along the edge of the first side wall of the third elongate portion being in sliding contact with the flange of a corresponding one of the side walls of the first elongate portion;

a guiding device coupling the first elongate portion, the second elongate portion, and the third elongate portion, the guiding device including a guide rod extending between the second elongate portion and the third elongate portion; and an actuator to drive movement of the second elongate portion and the third elongate portion along the guiding device, wherein the second elongate portion opposes the third elongate portion and the second elongate portion and third elongate portion are movable along the guide rod toward and away from each other, and wherein the second elongate portion and the third elongate portion are each movable relative to the first elongate portion.

12. The connector as claimed in claim 11 wherein each of the side walls of the first elongate portion has a flange extending along an edge thereof at a forty five degree angle relative to said corresponding one of the side walls of the first elongate portion.

13. The connector as claimed in claim 11 wherein the flange of the second elongate portion extends at approximately a one hundred and thirty five degree angle relative to the first side wall of the second elongate portion, and the flange of the third elongate portion extends at approximately a one hundred and thirty five degree angle relative to the first side wall of the third elongate portion.

14. The connector as claimed in claim 11 wherein:

the first elongate portion includes a mounting plate disposed between the two side walls thereof;

the second elongate portion is configured such that the first side wall thereof is perpendicular to the second side wall thereof and there is a mounting plate disposed between the first side wall and the second side wall of the second elongate portion;

the third elongate portion is configured such that the first side wall thereof is perpendicular to the second side wall thereof and there is a mounting plate disposed between the first side wall and the second side wall of the third elongate portion; and the guiding device includes a pair of spaced-apart feet, a divider disposed between the feet, and a guide rod extending through the feet and the divider, wherein each of the feet is mounted on a corresponding one of the mounting plate of the second elongate portion and the mounting plate of the third elongate portion, the divider is mounted on the mounting plate of the first elongate portion, and each of the feet is moveable along the guide rod between the divider and a corresponding stop on the guide rod to thereby move the second elongate portion and the third elongate portion toward and away from each other.

15. The connector as claimed in claim 11 further including a valve to allow lubricant to be discharged between the flange of the first elongate portion and the flange of the second elongate portion.

16. The connector as claimed in claim 11 further including a valve to allow lubricant to be discharged between the flange of the first elongate portion and the flange of the third elongate portion.

* * * * *